US005690030A

United States Patent [19]

Greive

[11] Patent Number: 5,690,030

[45] Date of Patent: Nov. 25, 1997

[54] DELIVERY SYSTEM FOR A PRINTING PRESS

[75] Inventor: Martin Greive, Heidelberg, Germany

[73] Assignee: Heidelberger Druckmaschinen AG, Heidelberg, Germany

[21] Appl. No.: 603,935

[22] Filed: Feb. 20, 1996

[30] Foreign Application Priority Data

Feb. 18, 1995 [DE] Germany ..... 195 05 599.3

[51] Int. Cl.[6] ..... B41F 13/24

[52] U.S. Cl. ..... 101/232; 271/221; 271/223; 271/213; 271/214; 271/215; 271/217

[58] Field of Search ..... 101/232; 271/213, 271/214, 215, 217, 221, 223, 224

[56] References Cited

U.S. PATENT DOCUMENTS

| | | | |
|---|---|---|---|
| 1,421,868 | 7/1922 | Volkmere | 271/221 |
| 1,823,042 | 9/1931 | Hartmann | 271/223 |
| 2,089,979 | 8/1937 | Nigra | 101/232 |
| 5,215,301 | 6/1993 | Oshino et al. | 271/224 |
| 5,297,787 | 3/1994 | Shirai | 271/223 |
| 5,429,475 | 7/1995 | Mohr | 271/221 |
| 5,483,888 | 1/1996 | Greive | 101/232 |
| 5,513,839 | 5/1996 | Green | 271/221 |

FOREIGN PATENT DOCUMENTS

| | | | |
|---|---|---|---|
| 740020 | 10/1943 | Germany | 271/223 |
| 0002575 | 1/1980 | Japan | 271/223 |
| 1252079 | 11/1971 | United Kingdom | 271/221 |
| 2046223 | 11/1980 | United Kingdom | 271/224 |

*Primary Examiner*—Eugene H. Eickholt

*Attorney, Agent, or Firm*—Herbert L. Lerner; Laurence A. Greenberg

[57] ABSTRACT

A combination of a printing press and a chainless delivery system therefor includes adjustable sheet stops disposed in a horizontal plane, the delivery system being subdivided into a part proximate to the press and a part distal to the press, one of the sheet stops being a rear sheet stop fixedly connected to the distal part of the press, the distal part being adjustable horizontally, together with the rear sheet stop, in a direction towards and away from the printing press.

10 Claims, 2 Drawing Sheets

DELIVERY SYSTEM FOR A PRINTING PRESS

BACKGROUND OF THE INVENTION

1. Field of the Invention

The invention relates to a delivery system for a printing press, wherein a sheet is conveyed from the printing press to a delivery device by transport rollers, in a manner similar to that for a chute delivery system, rather than by chain-guided grippers.

Conventional chute delivery systems wherein sheets are deposited in an oblique or inclined position, which affords relatively simple sheet removal, are suitable only for small print runs because the maximum height of a respective sheet pile is limited. In contrast therewith, chain delivery systems permit the formation of sheet piles having relatively great heights, however, the pile is not as readily accessible as with chute delivery systems. The accessibility of the sheet pile in the case of chain delivery systems becomes all the poorer the smaller the sheet size or format, because the printing press must be designed with a length sufficient for accommodating the largest sheet size or format.

2. Summary of the Invention

It is accordingly an object of the invention to provide a delivery system for a printing press wherein the sheet pile thereof is readily accessible even for small sheet sizes or formats, and which is furthermore suitable for piles of relatively great heights.

With the foregoing and other objects in view, there are provided, in accordance with the invention, in combination, a printing press and a chainless delivery system therefor, comprising adjustable sheet stops disposed in a horizontal plane, the delivery system being subdivided into a part proximate to the press and a part distal to the press, one of the sheet stops being a rear sheet stop fixedly connected to the distal part of the press, the distal part being adjustable horizontally, together with the rear sheet stop, in a direction towards and away from the printing press.

In accordance with another feature of the invention, the combination includes linear guides connecting the distal and the proximate part of the delivery system to one another.

In accordance with a further feature of the invention, the linear guides are disposed at respective opposite sides of the delivery system.

In accordance with an added feature of the invention, respective pairs of the linear guides are coupled to one another in tandem at respective opposite sides of the delivery system.

In accordance with an additional feature of the invention, the distal part of the delivery system has two side parts to each of which one end of the rear sheet stop is secured, each of the two side parts being, in turn, secured to one of the linear guides.

In accordance with yet another feature of the invention, the distal part of the delivery system has a covering which, together with the rear sheet stop, is adjustable towards and away from the printing press, the covering surrounding the delivery system in every setting thereof.

In accordance with yet a further feature of the invention, the adjustable sheet stops include two lateral sheet stops, and wherein the proximate part of the delivery system includes the two adjustable lateral sheet stops and a fixed front sheet stop.

In accordance with yet an added feature of the invention, at least one of the rear sheet stop and the lateral sheet stops is a jogger movable in synchronism with the printing press.

In accordance with yet an additional feature of the invention, the combination includes a respective drive for at least one of the rear sheet stop and the lateral sheet stops for producing both a jogging motion and an adjusting motion.

In accordance with a concomitant feature of the invention, the combination includes transport rollers disposed in a region between the delivery system and the printing press for transporting sheets from the printing press in a direction towards the rear sheet stop of the delivery system.

The part distal to the press, together with the rear sheet stop and, if necessary or desirable, a covering, forms a unit which can be moved towards the printing press for smaller sheet formats or sizes. Unlike conventional chain delivery systems, accessibility to the sheet pile is thus equally as good for all sheet sizes and, moreover, there is no sacrifice of installation space. Just as in chain delivery systems, however, the sheets are deposited horizontally so that large piles can be formed and taken away from the press.

The delivery system according to the invention is especially suitable for printing presses with level sheet guidance because, even at the delivery system, no further sheet deflection of the type occurring in chain delivery systems is necessary. Once the sheets pass the last printing unit, they are moved horizontally towards and against the rear sheet stops with the aid of transport rollers.

To enable an adjustment of the part of the delivery system distal to the press precisely horizontally, special linear guides are suited for connecting the part distal to the press to the part proximate to the press or for connecting the distal part of the delivery system to the printing press per se. Under some circumstances, one linear guide on each side of the delivery system is sufficient. If two linear guides are coupled one after the other, i.e., in tandem, at each side of the delivery system, however, then the delivery system can be set for an especially broad range of sheet sizes or formats.

In a preferred embodiment, the part of the delivery system distal to the press has two side parts, to each of which one end of the rear sheet stop is secured, the two side parts being each, in turn, secured to a linear guide. The part of the delivery system distal to the press, moreover, has a covering which, together with the rear sheet stop, is adjustable towards and away from the printing press, the covering surrounding the delivery system in every position thereof. The part of the delivery system proximate to the press includes two adjustable lateral sheet stops and one fixed front sheet stop. The rear sheet stop and the lateral sheet stops are joggers which are movable in synchronism with the press. One drive is sufficient for both the jogging motion and the adjusting motion for a respective sheet stop.

Other features which are considered as characteristic for the invention are set forth in the appended claims.

Although the invention is illustrated and described herein as embodied in a delivery system for a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

BRIEF DESCRIPTION OF THE INVENTION

FIG. 1 is a side elevational view of a chainless delivery system according to the invention diagrammatically illustrating a positioning thereof in two settings, respectively, for a maximum and a minimum sheet size or format; and FIG. 2 is a top plan view of FIG. 1, illustrating the setting thereof for the maximum sheet size or format in the upper half of the figure, and the setting thereof for the minimum sheet size or format in the lower half of the figure.

DESCRIPTION OF THE PREFERRED EMBODIMENT

Figure 1:
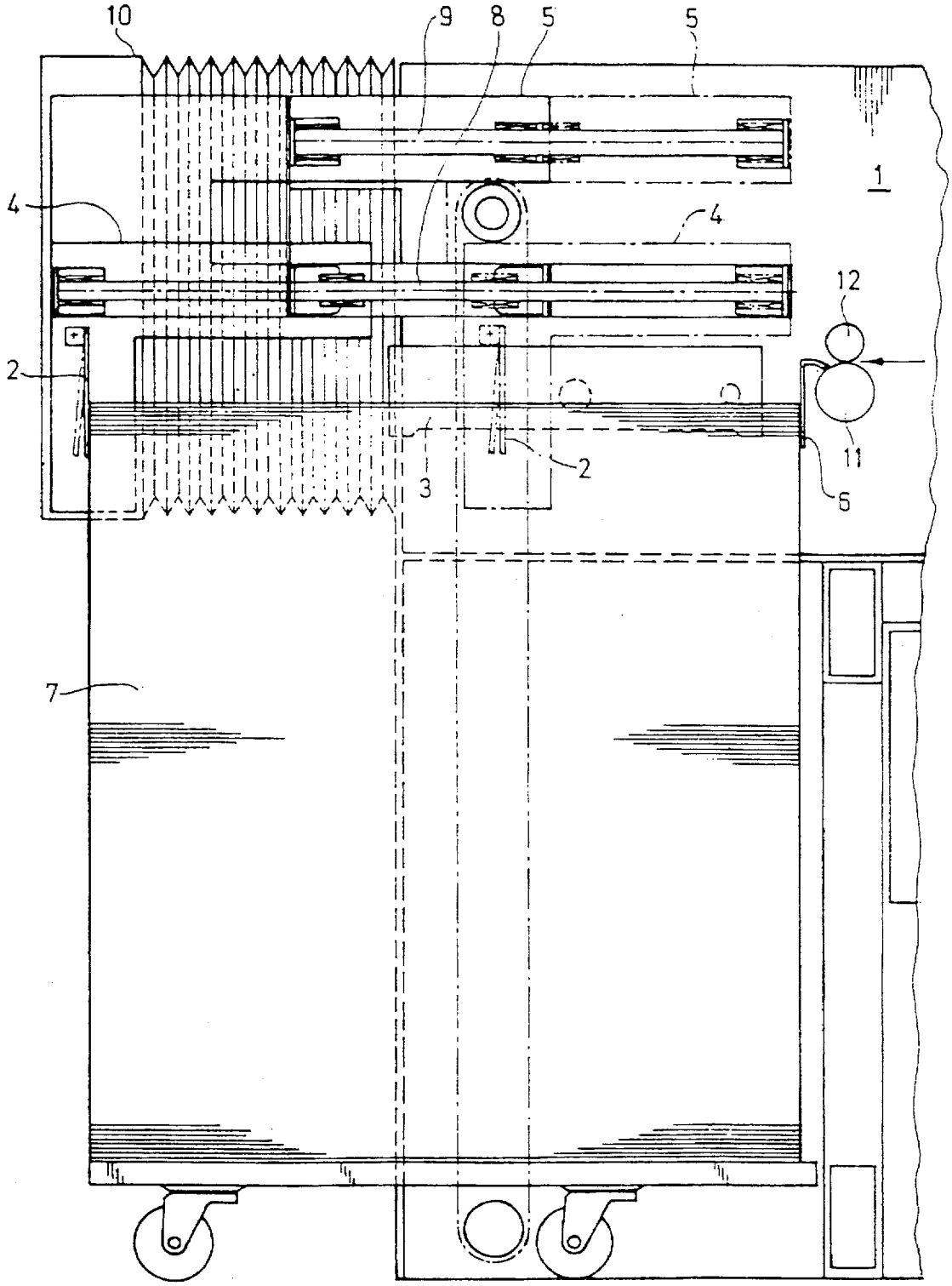

Referring now to the drawings and, first, particularly to FIG. 1 thereof, there is shown therein a delivery system according to the invention with part of a printing press 1, of which there are shown only transport rollers 11 and 12 which move the sheets from the printing press 1 towards and against a rear sheet stop 2 of the delivery system. The sheets then drop and, due to a motion of lateral sheet stops 3 towards one another and a motion of the rear sheet stop 2 in a direction towards a front sheet stop 6 which is fixed to the printing press, an even or straight sheet pile 7 is formed. Extreme positions of this jogging movement for the rear sheet stop 2 are shown diagrammatically in FIG. 1. The sheet stops 2, 3 and 6 are disposed in a uniform horizontal plane, and a carriage whereon the sheet pile 7 is formed is lowered as the height of the pile increases.

To set the lateral sheet stops 3 for varying sheet sizes or formats, they are displaceable horizontally counter to one another. Moreover, the rear sheet stop 2, in combination with the part of the delivery system shown at the left-hand side of FIG. 1, i.e., that part thereof which is remote from or distal to the printing press 1, is displaceable horizontally towards that part of the delivery system proximate to the printing press, which is located at the right-hand side of FIG. 1 or, in other words, is displaceable towards and away from the printing press 1, as is described hereinafter in detail with simultaneous reference to FIGS. 1 and 2.

Figure 2:
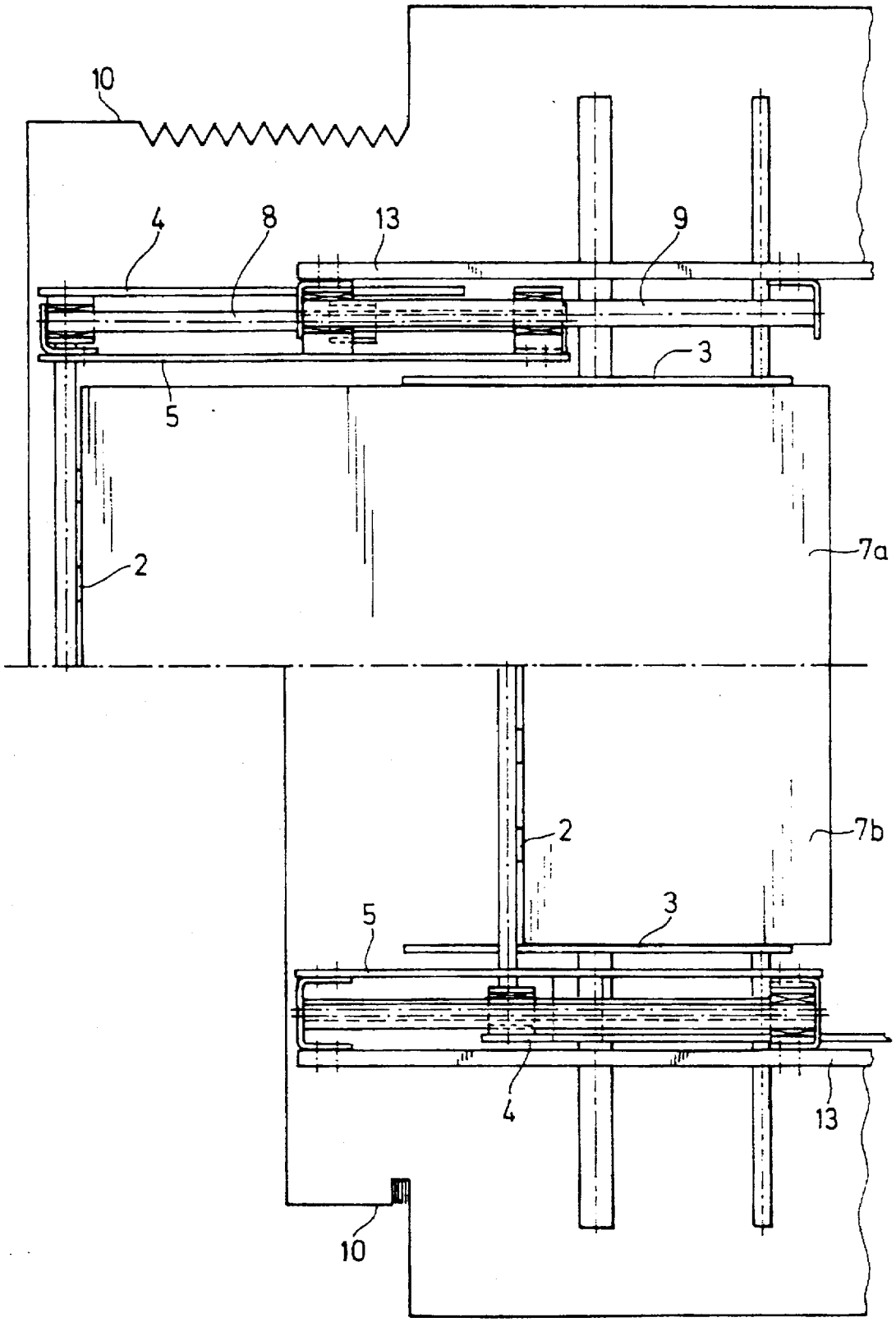

In FIG. 1, the essential parts of the delivery system are shown in the two set positions, respectively, for the maximum and the minimum sheet size and format and, in FIG. 2, these essential parts are shown in the upper half of the drawing for the maximum sheet size or format at 7*a* and in the lower half of the drawing for the minimum sheet size or format at 7*b*.

The rear sheet stop 2 is secured at each of the ends thereof to a downwardly directed leg of an L-shaped side part 4. The other leg of each side part 4 extends horizontally and is guided, horizontally displaceably, along a respective first linear guide 8. These first linear guides 8 are each secured to a further side part 5, which in turn is guided, horizontally displaceably, on a respective second linear guide 9. The second linear guides 9 are each joined to a side wall 13 (note FIG. 2) of the printing press 1. The respective linear guides 8 and 9 are coupled in tandem and form a telescoping guide with a wide adjusting range for that part of the delivery system which is remote from or distal to the printing press 1.

The first and second linear guides 8 and 9 are shown in the figures as round bars, however, generally linear guides of any arbitrary cross section or design, which are collapsible and extensible telescopically, may be employed.

A respective first linear guide 8 and a respective second linear guide 9 mutually spaced apart above one another, and the L-shaped side parts 4 and the further side parts 5 are substantially flat and, moreover, are disposed on a respective side of the linear guides 8 and 9 in planes which are parallel to and spaced apart from the side walls 13 of the printing press 1, so as to enable an unhindered movement thereof counter to one another and relative to the side walls 13.

The adjusting motion and the jogging motion of the rear sheet stop 2 can both be generated by a single non-illustrated drive, for example, via a motor which produces a movement by means of an eccentric disk. This applies as well for the lateral sheet stops 3.

An external covering 10 of the delivery, partly formed as a bellows or an accordion, can be folded together towards the printing press 1 for smaller sheet sizes or formats. The covering 10 may be connected to the further side parts 5 and may be displaced conjointly therewith. Instead of the bellows-like or accordion-like version which is illustrated, other coverings which permit a shifting thereof may also be used.

As can be seen from the figures of the drawings, in the setting for the minimum sheet size or format at 7*b*, the effective total length of the printing press is reduced considerably, because the entire rear part of the delivery system remote from or distal to the printing press 1 is located closer to the printing press 1. The end of the delivery system which is essentially defined by the ends of the second side parts 5 protrudes only slightly beyond the rear edge of the sheet pile 7. The accessibility to the sheet pile 7 is therefore practically equally as good for all sheet sizes or formats, and no installation space is sacrificed.

If the minimum possible sheet size or format is designed to be somewhat larger, it may be sufficient then to provide, in an embodiment which is not illustrated herein, only a single pair of linear guides, whereon the rear sheet stop 2 is guided and which are connected directly to the printing press 1. In such a case, the afore-described advantages remain preserved in their entirety.

I claim:

1. In combination, a printing press and a chainless delivery system therefor, comprising adjustable sheet stops disposed in a horizontal plane, the delivery system being subdivided into a part proximate to the press and a part distal to the press, one of said sheet stops being a rear sheet stop fixedly connected to said distal part of the delivery system, said distal part being adjustable horizontally, together with said fixedly connected rear sheet stop, in a direction towards and away from the printing press for adjusting a size of the delivery system to a format size being processed in the printing press.

2. The combination according to claim 1, including transport rollers disposed in a region between the delivery system and the printing press for transporting sheets from the printing press in a direction towards said rear sheet stop of the delivery system.

3. In combination, a printing press and a chainless delivery system therefor, comprising adjustable sheet stops disposed in a horizontal plane, the delivery system being subdivided into a part proximate to the press and a part distal to the press, one of said sheet stops being a rear sheet stop fixedly connected to said distal part of the delivery system, said distal part being adjustable horizontally, together with said rear sheet stop, in a direction towards and away from the printing press, and linear guides connecting said distal and said proximate part of the delivery system to one another.

4. The combination according to claim 3, wherein said linear guides are disposed at respective opposite sides of the delivery system.

5. The combination according to claim 3, wherein respective pairs of said linear guides are coupled to one another in tandem at respective opposite sides of the delivery system.

6. The combination according to claim 3, wherein said distal part of the delivery system has two side parts to each of which one end of said rear sheet stop is secured, each of said two side parts being, in turn, secured to one of said linear guides.

7. The combination according to claim 3, wherein said distal part of the delivery system has a covering which, together with said rear sheet stop, is adjustable towards and away from the printing press, said covering surrounding the delivery system in every setting thereof.

8. The combination according to claim 3, wherein said adjustable sheet stops include two lateral sheet stops, and wherein said proximate part of the delivery system includes said two adjustable lateral sheet stops and a fixed front sheet stop.

9. The combination according to claim 8, wherein at least one of said rear sheet stop and said lateral sheet stops is a jogger movable in synchronism with the printing press.

10. The combination according to claim 9, including a respective drive for at least one of said rear sheet stop and said lateral sheet stops for producing both a jogging motion and an adjusting motion.

* * * * *